United States Patent [19]

Jones

[11] Patent Number: 4,511,298

[45] Date of Patent: Apr. 16, 1985

[54] PROTECTIVE BINDER

[75] Inventor: Charles E. Jones, Evanston, Ill.

[73] Assignee: Moore Business Forms, Inc., Grand Island, N.Y.

[21] Appl. No.: 472,765

[22] Filed: Mar. 7, 1983

[51] Int. Cl.[3] ..... B42B 5/06; B42B 5/00; B42F 13/00; B42C 9/08

[52] U.S. Cl. ..... 412/34; 412/33; 412/28; 402/75

[58] Field of Search ..... 281/29, 42; 402/14, 402/15, 75; 412/28, 83, 34

[56] References Cited

U.S. PATENT DOCUMENTS

| | | | |
|---|---|---|---|
| 2,434,502 | 1/1948 | Martin et al. | 412/28 |
| 2,524,259 | 10/1950 | Hildman | 412/28 |
| 4,007,950 | 2/1977 | Giulie | 402/14 |
| 4,141,100 | 2/1979 | Domroe et al. | 412/34 |
| 4,314,716 | 2/1982 | Errichiello | 402/75 |

FOREIGN PATENT DOCUMENTS

| | | | |
|---|---|---|---|
| 6711263 | 2/1969 | Netherlands | 412/901 |

*Primary Examiner*—Paul A. Bell

*Assistant Examiner*—Paul M. Heyrana, Sr.

*Attorney, Agent, or Firm*—Allegretti, Newitt, Witcoff & McAndrews, Ltd.

[57] ABSTRACT

A protective binder for storing and protecting printed or written material normally contained on multiple pages of unbound materials. The binder includes a unitarily formed and foldable semi-rigid member, preferably made of a thermo-formed polypropylene material. The foldable member has a front cover, a back cover, and a rear edge section. Hinge portions are unitarily formed between the front cover and the rear cover and the rear edge section, thereby flexibly interconnecting the front and rear covers to the rear edge section. A clear, elongated, flexible tape is bonded along a central section thereof to the rear edge section. An adhesive is provided along interior portions of the tape for securement to the front and rear pages of materials to be bonded or secured in place within the binder. The tape is free of any adhesive on the outer surfaces thereof which are adjacent the front and rear covers. The pages are securely received by the tape for storage between the front and rear covers.

6 Claims, 8 Drawing Figures

PROTECTIVE BINDER

BACKGROUND OF THE INVENTION

Field of the Invention and Description of the Prior Art

This invention relates to presentation binders for storing and/or protecting a collection of loose-leaf pages, magazines, and similar materials normally having no hard cover.

Presentation binders are commonly used in libraries for protecting and storing loose-leaf pages that are held together in various ways, such as by use of staples. These binders are also used for protecting magazines, manuscripts, doctors' and master's theses and the like. The binders are generally made of a rigid or semi-rigid material and include opaque tape which is secured within the binder itself and which is adhesively secured to the front and back pages of the bound or stapled material which is to be stored therein. There is considered to be a need for providing improved presentation binders which are durable, inexpensive to manufacture, and which do not utilize opaque tape that obliterates marginal edge portions of the front and back pages of the material being stored.

SUMMARY OF THE INVENTION

It is therefore an object of the present invention to provide an improved presentation binder for storing loose-leaf materials or the like wherein the binder is formed of semi-rigid plastic material for economy of construction and durability in use.

It is an object of the present invention to provide an improved presentation binder having an unitarily thermo-formed front and back cover and an interior clear tape bonded therein for securing bound loose-leaf pages, manuscript, or the like therein.

It is still another object of the present invention to provide an improved presentation binder that is formed from polypropylene and is made by thermoforming techniques so as to provide for economy of construction and durability in use.

Further purposes and objects of the present invention will appear as the specification proceeds.

The foregoing objects are accomplished by providing a protective binder for holding and protecting one or more pages containing information thereon, the binder including a unitarily formed and foldable semi-rigid member, the foldable member having a front cover, a back cover, and a contiguous rear edge section, hinge defining portions unitarily formed with the foldable member for flexibly interconnected both the front cover and the back cover to the rear edge, the rear edge having an interior surface, an elongated clear, flexible tape member having one surface thereof bonded to the interior surface of the rear edge for substantially its entire length, the tape having bonding or adhesive means provided on one side thereof for securely receiving the front and back sides of the pages to be stored therein, the tape being free of adhesive on the other surface thereof, the front and rear pages being securely received by the adhesive on the tape for securement between the front and back covers.

BRIEF DESCRIPTION OF THE DRAWINGS

One particular embodiment of the present invention is illustrated in the accompanying drawings wherein.

DETAILED DESCRIPTION OF THE PREFERRED EMBODIMENT

Figure 1:
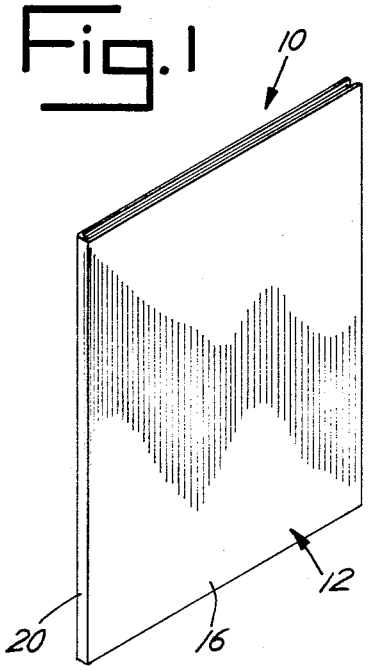
FIG. 1 is a pictorial view of our presentation binder, shown in the closed position.
Figure 2:
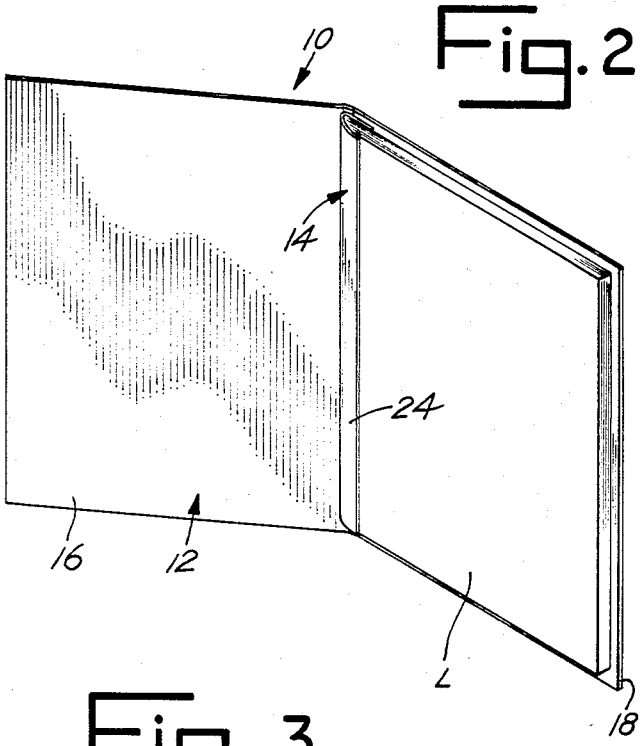
FIG. 2 is a pictorial view of the presentation binder of FIG. 1, showing the binder in the open position with multiple pages secured in place therein.

Referring to FIGS. 1 and 2, my improved presentation binder assembly, generally 10, is pictorially illustrated, both in the closed position and in the open position with loose-leaf material or the like contained therein. Although as seen best in FIG. 2, the presentation binder 10 is shown containing a collection of loose-leaf materials which may be, for example, stapled along the left-hand margin thereof, it is to be understood that the presentation binder 10 may be utilized for storing a wide range of similar materials, normally having no hard cover, such as magazines, original manuscripts, prints, masters' and doctors' theses and the like. Generally, the binder 10 is used for storing a relatively small number of loose-leaf pages or the like. The binder 10 is not to be used for storing large quantities of materials, such as shown, for example, in the data binder disclosed in co-pending application Ser. No. 393,318 of William C. Updegrave, entitled "Binder for Business Forms". Because of its durability, the binder 10 is particularly useful for storing loose-leaf materials and is frequently used for library materials.

Figure 3:
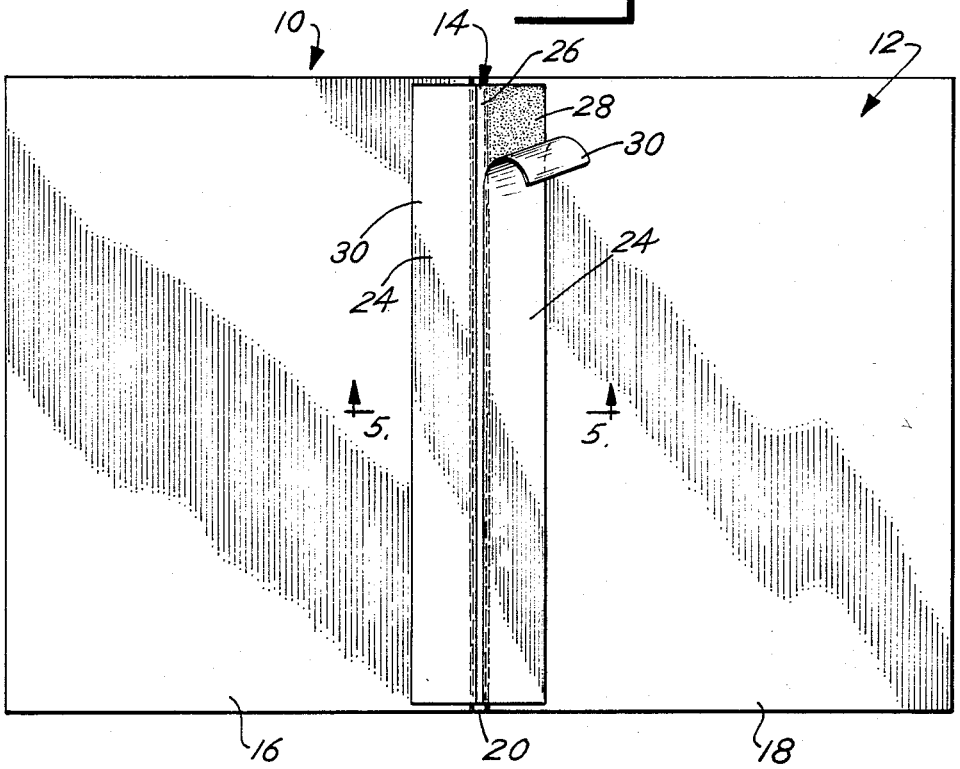
FIG. 3 is a plan view of the presentation binder of FIGS. 1 and 2, without pages secured therein, and particularly showing the tape used for bonding the pages therein.
Figure 4:
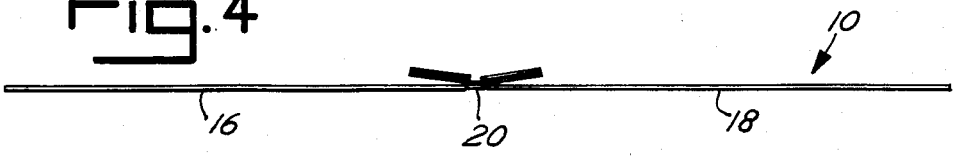
FIG. 4 is an end elevational view of the presentation binder embodied in FIG. 3.

Referring to FIG. 3, in particular, the binder 10 includes a unitarily formed and foldable semi-rigid member, generally 12, and an elongated flexible tape member, generally 14, which is bonded centrally of the foldable member 12 when in the open position.

The foldable member 12 is formed from a planar sheet of plastic material, preferably polypropylene, of a known type, and utilizes thermo-forming techniques in the manufacture thereof. Polypropylene is known to have unique properties enabling there to be selected hinging action between adjacent rigid or semi-rigid parts of the same formed unitary sheet or blank. For this reason, polypropylene is highly preferred over other materials which could, conceivably, be used. One important known property of polypropylene is that it provides a "living hinge" action that accomplishes the desired hinging action between selected portions of the rigid or semi-rigid parts of the foldable member 12.

Referring to FIG. 3, the foldable member 12 is substantially planar, when in the open position, and generally includes a front cover or wall 16, a rear cover or wall 18, and a rear edge 20. The front wall 16, the rear wall 18 and the rear edge 20 are all rigid or semi-rigid, and unitarily formed. Unitarily formed, flexible hinged sections 22, as best seen, for example, in the enlarged embodiments illustrated in FIGS. 5–8, are provided on opposite sides of the rear edge 20. The hinged sections 22 are contiguous with both the rear edge 20 and both the front wall 16 and the rear wall 18. As seen best in FIG. 8, the hinge sections 22 enable the front cover 16 to be folded over the rear cover 18 with the loose-leaf pages held therebetween. The front wall 16 and rear wall 18 are substantially the same dimensions as each other and slightly larger than the pages stored therein. The rear edge 20 is of the same height as the walls 16 and 18 but is quite narrow relative to the width of both the front wall 16 and the rear wall 18.

Figure 5:
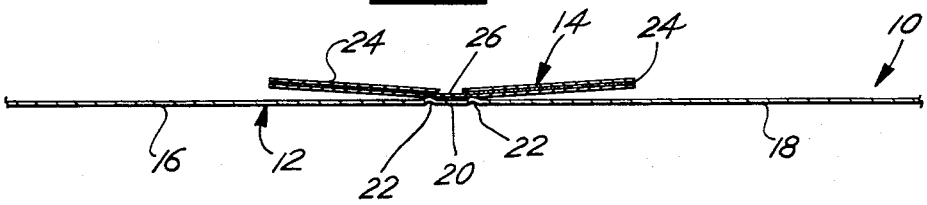
FIG. 5 is an enlarged, partially broken sectional view of the binder taken along the line 5—5 of FIG. 3.

Referring to FIG. 3, a flexible tape member 14 is centrally positioned along the interior surface of the rear edge 20 of the foldable member 12 of the binder 10. The tape includes a pair of substantially equidistantly projecting marginal edge portions 24 and an intermediate section 26 which is bonded to the interior surface of the rear edge section 26. Referring to FIGS. 3 and 5, the flexible tape member 14 has adhesive 28 applied to the inner surface thereof while the outer surface is free of any adhesive means so that the outer surface does not become attached in any way to the interior surfaces of the front and rear walls 16 and 18. A peelable release paper covering 30 is removably secured and covers the adhesive side 28 of the tape 14. In order to facilitate the bonding of the tape 14 to the interior surface of the rear edge 20, the release paper 30 is placed over both of the marginal edge portions 24 only, thereby leaving a portion of the intermediate section 26 uncovered. Advantageously, the tape 14 is made of Mylar or similar film which may be heat bonded or thermally bonded by the application of heat both to the tape 14 and to the rear edge section 20 in order to securely bond the tape 14 to the member 12. Alternatively, a suitable adhesive may be applied in order to bond the tape 14 to the rear edge section 20.

Figure 6:
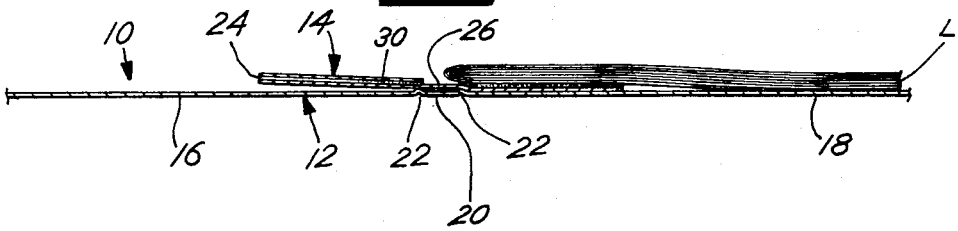
FIG. 6 is a view, similar to FIG. 5, showing multiple pages of material bonded to one side of the tape provided in the binder assembly.
Figure 7:
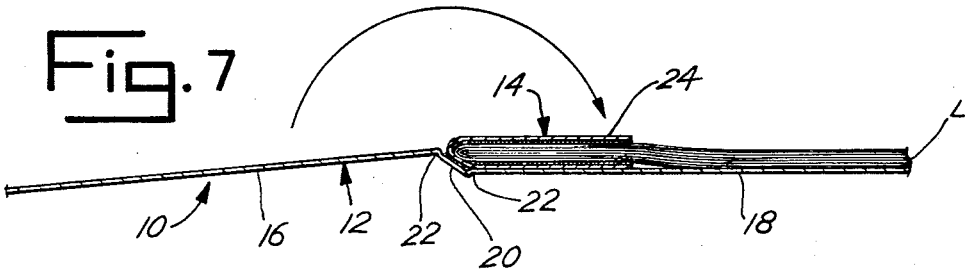
FIG. 7 illustrates both sides of the tape bonded to the stored material.
Figure 8:
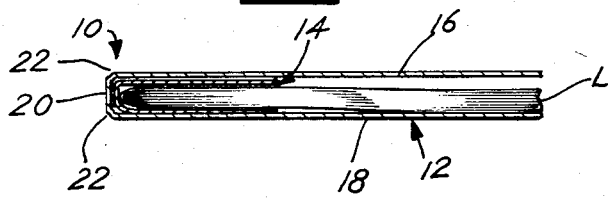
FIG. 8 is a view similar to FIG. 7 except showing the binder in the closed position.

In use, referring to FIGS. 5–8, the release paper 30 is removed from one of the marginal edge portions 24 in order to expose the adhesive 28. In the open position, a magazine or a collection of loose-leaf materials L has the marginal left-hand edge portion of a page secured against the adhesive 28 so the edge portion of the loose-leaf collection is substantially contiguous with the intermediate section 26 of the tape 14, as best seen in FIG. 6. The other release paper 30 is then removed from the other marginal edge portion 24 in order to expose the adhesive and the tape is folded over with the adhesive against the front cover page of the loose-leaf materials L. The cover is then folded over into the closed position as seen in FIG. 8. It is highly desirable for the tape 14 to be constructed of a clear plastic material. In this way, both the front and rear cover and left-hand marginal edge portions of the loose-leaf material which normally contains drawings, or other written indicia, are not obliterated in any way by the securing tape 14.

The presentation binder 10 thereby accomplishes all the objects previously set forth. The binder 10 is of a highly durable construction and is constructed in a simple and economical manner. The securing tape for securing the loose-leaf materials L in place is clear and therefore it does not obliterate other indicia provided on the front and rear covers. In use, the binder is very durable and provides a high degree of protection for the materials stored within the binder 10.

While in the foregoing there has been provided a detailed description of a particular embodiment of the present invention, it is to be understood that all equivalents obvious to those having skill in the art are to be included within the scope of the invention as claimed.

What I claim and desire to secure by Letters Patent is:

1. A protective binder for holding and protecting one or more pages containing information and the like thereon, said binder comprising a unitarily formed and foldable semi-rigid member, said foldable member having a front cover, a back cover, and a contiguous rear edge section between said front and back covers, hinge defining means unitarily formed by said foldable member for flexibility interconnecting both said front cover and said back cover to said rear edge section, said rear edge section having an interior surface, elongated flexible tape means having a central portion thereof bonded to said interior surface of said rear edge for substantially the entire length of said tape and said rear edge and having a projecting edge portion adjacent said central portion overlapping at least one of said covers said tape having bonding means for securely receiving said pages, said tape being free of said bonding means on the surface thereof adjacent said overlapped cover, said pages being securely received by said bonding means on said tape for securement between said front and back covers.

2. The binder of claim 1 wherein said tape means is made of a substantially clear flexible material for avoiding obliteration of any printed material to which said tape means is bonded.

3. The binder of claim 1 wherein said foldable member is a thermo-formed polypropylene material.

4. The binder of claim 1 wherein said elongated tape means is bonded to said interior surface of said rear edge by a thermo-bond.

5. The binder of claim 1 wherein a releasable material originally covers said bonding means.

6. A protective binder for holding and protecting one or more pages containing information and the like thereon, said binder comprising a unitarily formed and foldable semi-rigid member, said foldable member having a front cover, a back cover, and a contiguous rear edge section between said front and back covers, hinge defining means unitarily formed by said foldable member for flexibility interconnecting both said front cover and said back cover to said rear edge section, said rear edge section having an interior surface, elongated flexible tape means having a central portion thereof bonded to said interior surface of said rear edge section for substantially the entire length of said tape and said interior surface of said rear edge section, said elongated flexible tape means further having projecting side portions adjacent said central portion on both sides thereof overlapping a portion of said front and back covers, said projecting side portions having a flat surface facing said front and back covers and a second surface opposite said first surface, said tape having bonding means for securely receiving said pages, said tape being free of said bonding means on first surfaces of said projecting side portions, whereby said pages may be securely received by said bonding means on said tape for securement between said front and back covers while said first surface of said side portion is not bonded to said front and back covers.

* * * * *